US006849009B1

(12) United States Patent
Forlini

(10) Patent No.: US 6,849,009 B1
(45) Date of Patent: Feb. 1, 2005

(54) PRACTICE BACKSTOP/NET SYSTEM

(76) Inventor: Tracy Forlini, 342 Country La., Orange, CT (US) 06477

( * ) Notice: Subject to any disclaimer, the term of this patent is extended or adjusted under 35 U.S.C. 154(b) by 0 days.

(21) Appl. No.: 10/347,647

(22) Filed: Jan. 15, 2003

Related U.S. Application Data

(60) Provisional application No. 60/350,202, filed on Jan. 17, 2002.

(51) Int. Cl.[7] ..... A63B 63/04; A63B 69/36

(52) U.S. Cl. ..... 473/446

(58) Field of Search ..... 473/446, 476, 473/478, 197, 490, 491; 273/398, 400, 407, 408

(56) References Cited

U.S. PATENT DOCUMENTS 2,292,109 A * 8/1942 Engel ..... 473/421
2,819,901 A * 1/1958 Mateja ..... 473/421
3,408,071 A * 10/1968 Lundy ..... 473/421
4,072,295 A * 2/1978 Roberts ..... 256/26
5,205,564 A * 4/1993 Lamberti et al. ..... 273/400
5,277,430 A * 1/1994 Naccarato ..... 473/446
5,516,115 A * 5/1996 McLain ..... 473/417
5,564,711 A * 10/1996 Scheie ..... 273/400
5,577,721 A * 11/1996 Hardee et al. ..... 473/421
6,083,124 A * 7/2000 Williams ..... 473/421
6,379,272 B1 * 4/2002 Gorgo et al. ..... 473/421
6,485,373 B1 * 11/2002 Stephens ..... 473/197

* cited by examiner

*Primary Examiner*—Gregory Vidovich
*Assistant Examiner*—Nini F. Legesse
(74) *Attorney, Agent, or Firm*—Melvin I. Stoltz

(57) ABSTRACT

By providing a fully adjustable net system which is quickly and easily mounted to any hockey goal assembly for peripherally surrounding the outer edges of the goal assembly and establishing an expanded protected area or zone, an easily used, readily deployable backstop or net system is attained which may be employed by a wide variety of sports enthusiasts, for controlling or preventing unwanted, errant shots from damaging property or people in the surrounding area. Furthermore, the net system of the present invention may be constructed in a wide variety of alternate sizes, shapes, and configurations for achieving broad based use and applicability.

10 Claims, 14 Drawing Sheets

PRACTICE BACKSTOP/NET SYSTEM

RELATED APPLICATIONS

This application is related to provisional patent application Ser. No. 60/350,202, filed Jan. 17, 2002 entitled Practice Backstop/Net System.

TECHNICAL FIELD

This invention relates to backstops or net systems for use in a wide variety of sports activities and, more particularly to an easily constructed backstop/net system constructed for use during practice.

BACKGROUND ART

For many years, sports has been an important activity in which both adults and children participate. In particular, sports such as baseball, hockey, football, basketball, etc., have captured the interest of children of various ages, resulting in numerous organized sports activities as well as neighborhood games played between friends.

In playing these various games, both for competition and practice, many children have encountered difficulty in completely controlling the ball or puck being used. Consequently, injuries and/or property damage has occurred by errant balls or pucks being shot and high velocity into the surrounding area.

Although this problem has existed for many years, no realistically viable, easily used or easily deployed protective netting is available for use by children.

Furthermore, in many practice situations, it is desirable to throw a ball or puck at a particular target in order to improve one's accuracy in throwing. However, although in various target constructions prior art systems, these prior art constructions are devoid of any positive reinforcement, as well as being difficult to use on a continuing, repeated basis.

Therefore, it is a principal object of the present invention to provide a backstop or net system which is capable of being quickly and easily erected and provides shot blocking capabilities to a greatly enlarged area.

Another object of the present invention is to provide a backstop or net system having the characteristic features described above which is capable of being described in a wide variety of activities and for a wide variety of alternate sports.

Another object of the present invention is to provide a backstop or net system having the characteristic features described above which is constructed in a modular form for enabling rapid assembly and disassembly, as well as ease of transportation and storage.

Other and more specific objects will in part be obvious and will in part appear hereinafter.

SUMMARY OF THE INVENTION

By employing the present invention, all of the difficulties and drawbacks found in the prior art have been eliminated and an easily used, readily deployable backstop or net system is attained. Although the backstop or net system of the present invention may be employed by a wide variety of sports enthusiasts, for controlling or preventing unwanted, errant shots from damaging property or people in the surrounding area, the backstop or net system of the present invention is particularly suited for use in combination with a standard hockey goal, such as employed for either ice hockey and street hockey.

In one embodiment of the present invention, a fully adjustable net system is quickly and easily mounted to any hockey goal assembly for peripherally surrounding the outer edges of the goal assembly and establishing an expanded protected area or zone for achieving the desired backstop or blockage of errant shots aimed at the goal assembly. Furthermore, the net system of the present invention may be constructed in a wide variety of alternate sizes, shapes, and configurations for achieving broad based use and applicability. In one preferred embodiment, arcuately curved segments are employed for establishing the outer edge of the net system.

In this construction, support struts are mounted at various locations along the outer edges of the goal member and netting material is secured between the outer edges of the arcuately curved segments forming the net system and the outer edges of the goal assembly. In this way, an easily constructed, readily deployable, effective and fully adjustable backstop is achieved for blocking any and all missed shots which were made in reasonably close proximity to the goal.

In addition to providing an easily constructed backstop which may be deployed to achieve virtually any desired extended area, this embodiment of the present invention may be constructed in any desired visual appearance or configuration. In addition, the backstop or net system of the present invention can be mounted to any desired edge member forming the existing goal assembly, whether that edge member forms the front edge, rear edge, or intermediate sides of the goal assembly. As a result, a universally employable, highly effective, easily constructed, fully adjustable backstop or net system is realized.

In an alternate preferred embodiment, two generally rectangular frame members are mounted to opposed side edges of the goal system, with a third rectangular frame member mounted to the top edge of the goal system. In addition, netting material is connected to the rectangular shaped frame members, extending within and effectively closing the area formed by each frame member. In this way, an alternate construction for an easily assembled backstop for a goal system is realized.

In the preferred construction of this embodiment of the present invention, each of the two principal frame members are mounted to opposed side edges of the goal member and secured thereto, in a manner which enables each frame member to be arcuately pivotable relative to the goal member. In this way, the precise position of the backstop frame members can be adjusted, in order to accommodate any particular area or location and the dimensional limitations thereof.

The invention accordingly comprises an article of manufacture possessing the features, properties, and relational components which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

Figure 6:
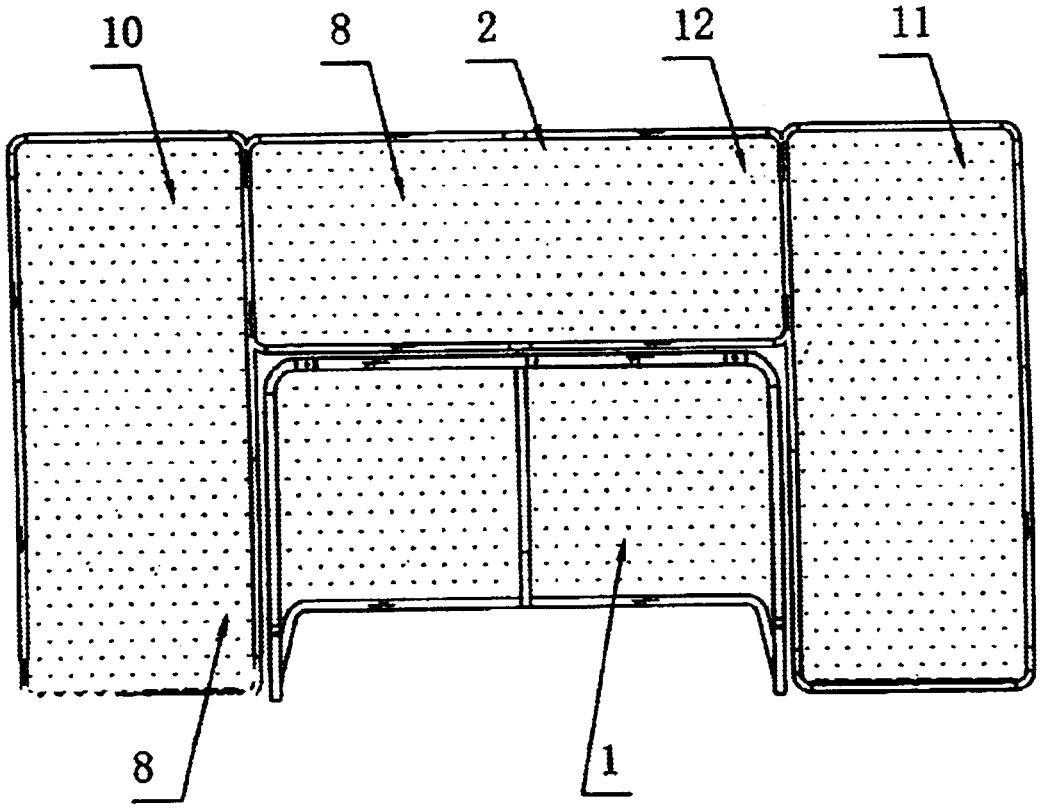
Figure 7:
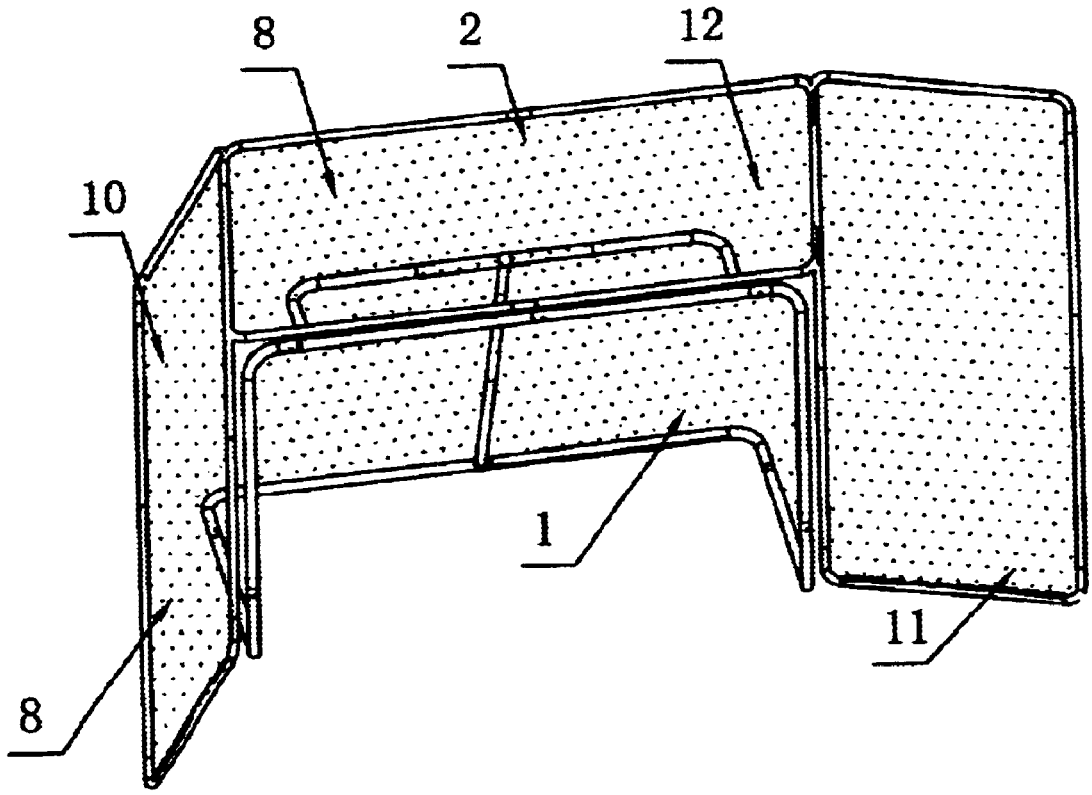
Figure 8:
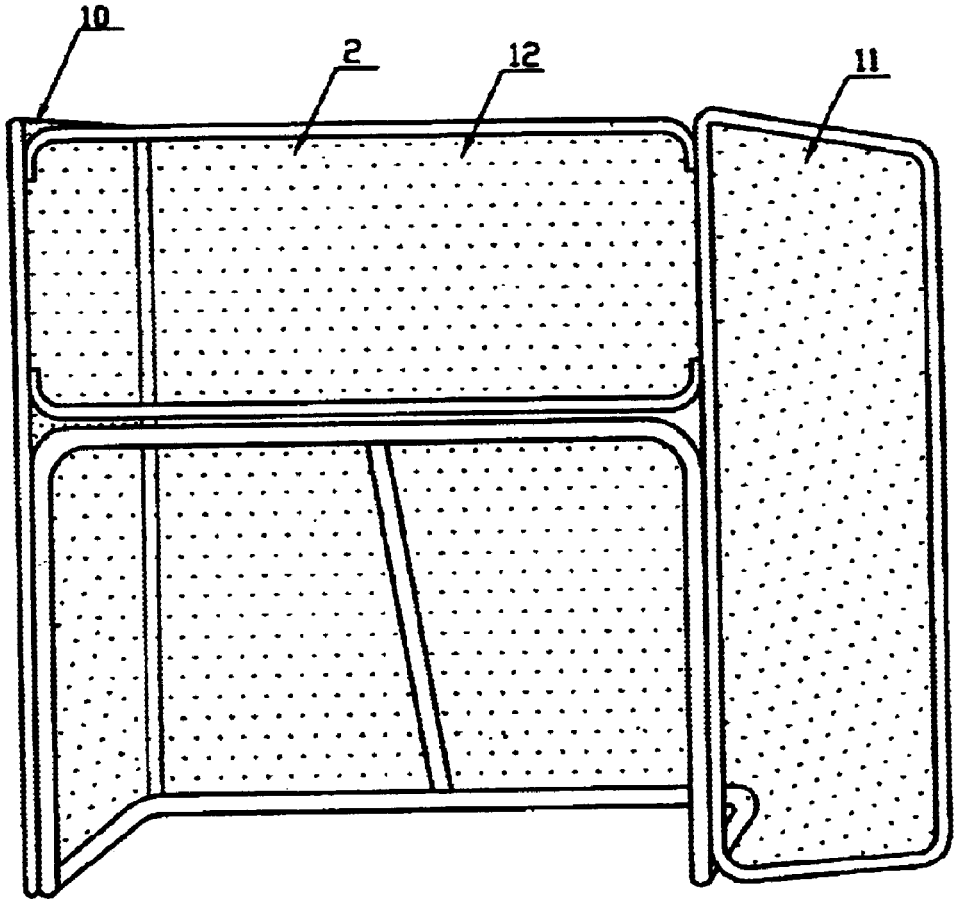
Figure 9:
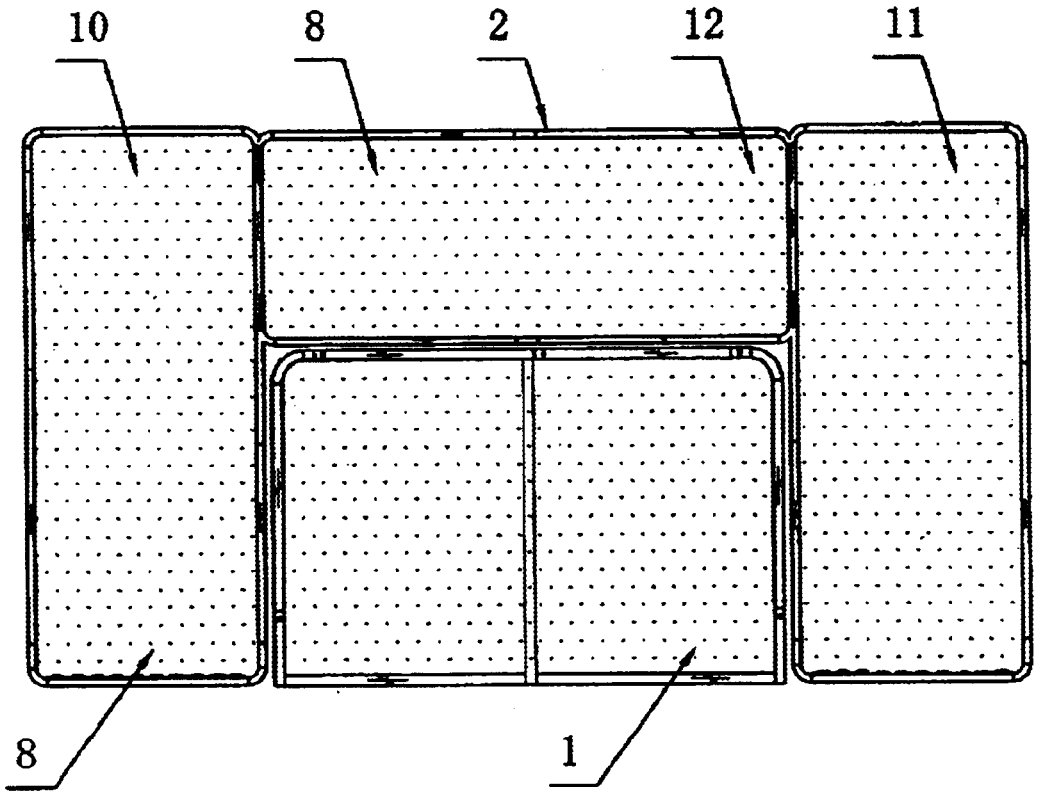
Figure 10:
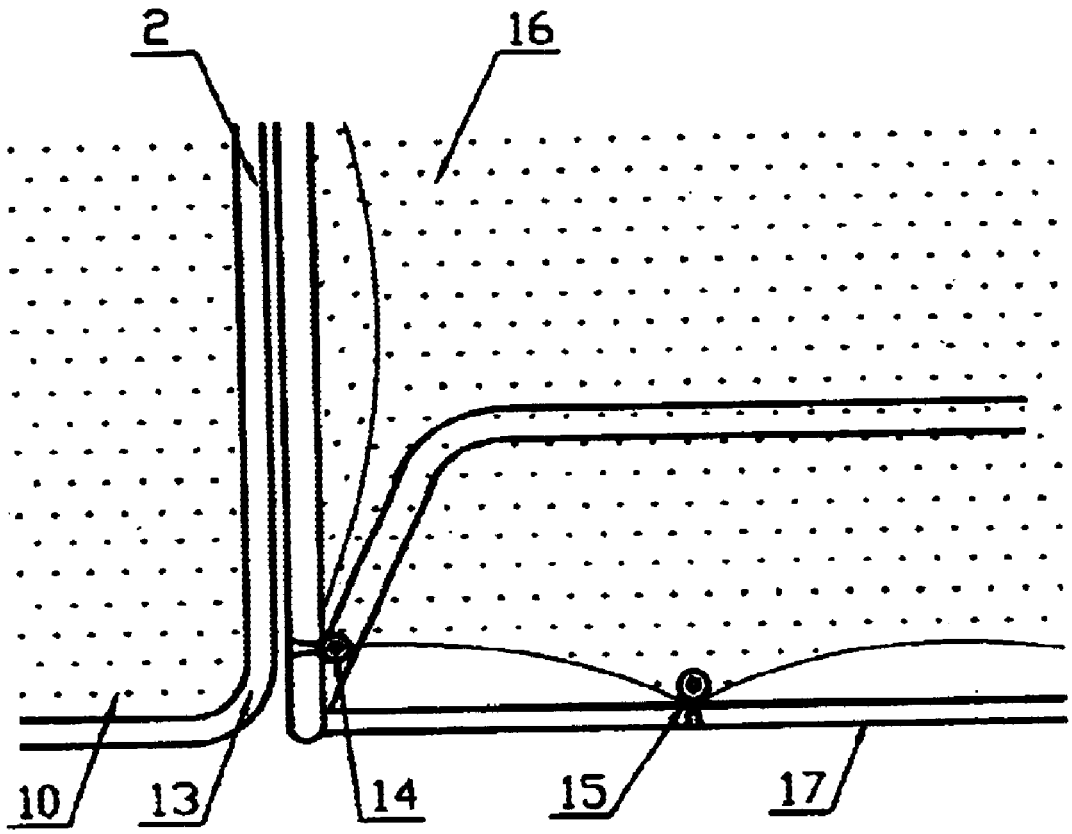
Figure 13:
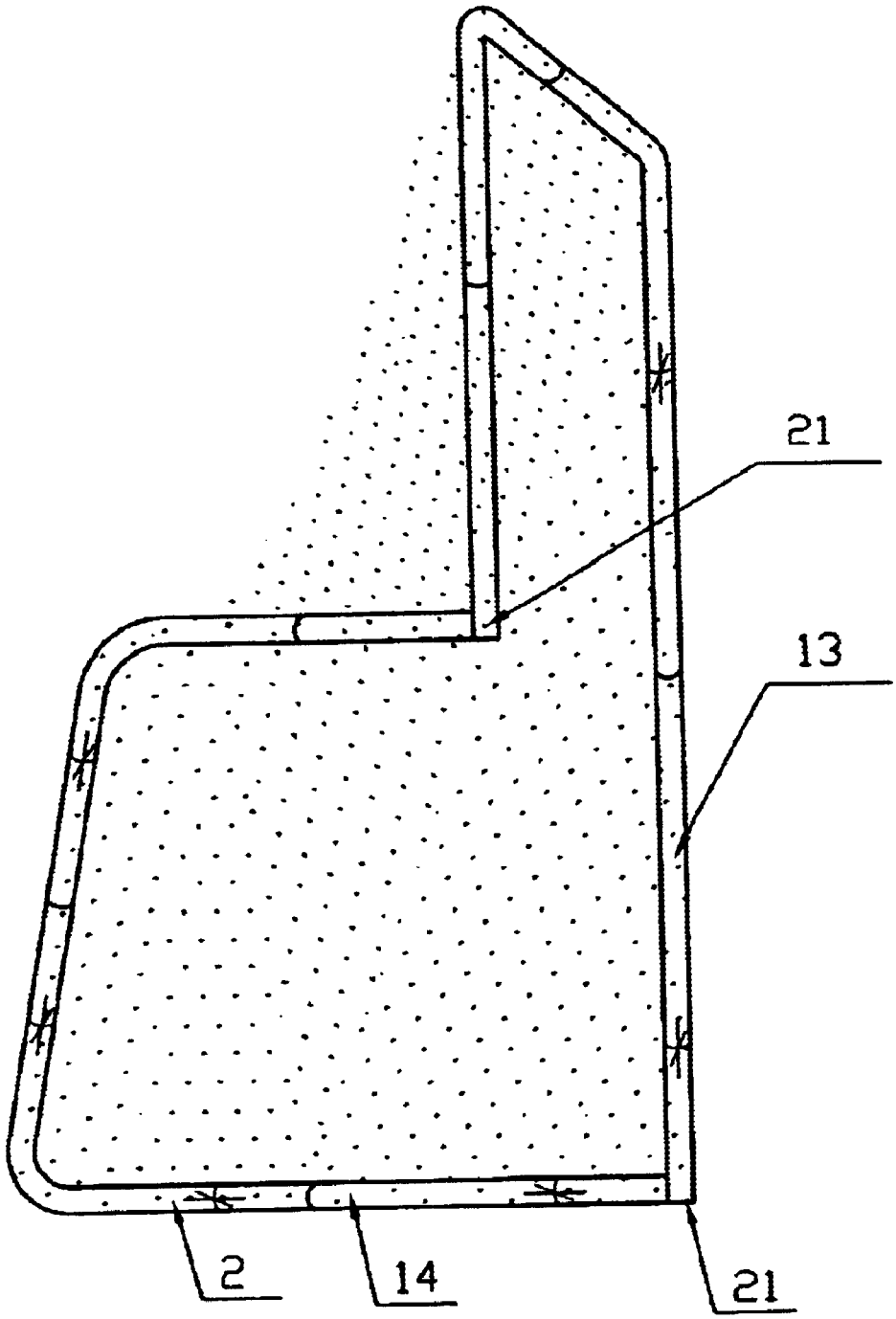
Figure 14:
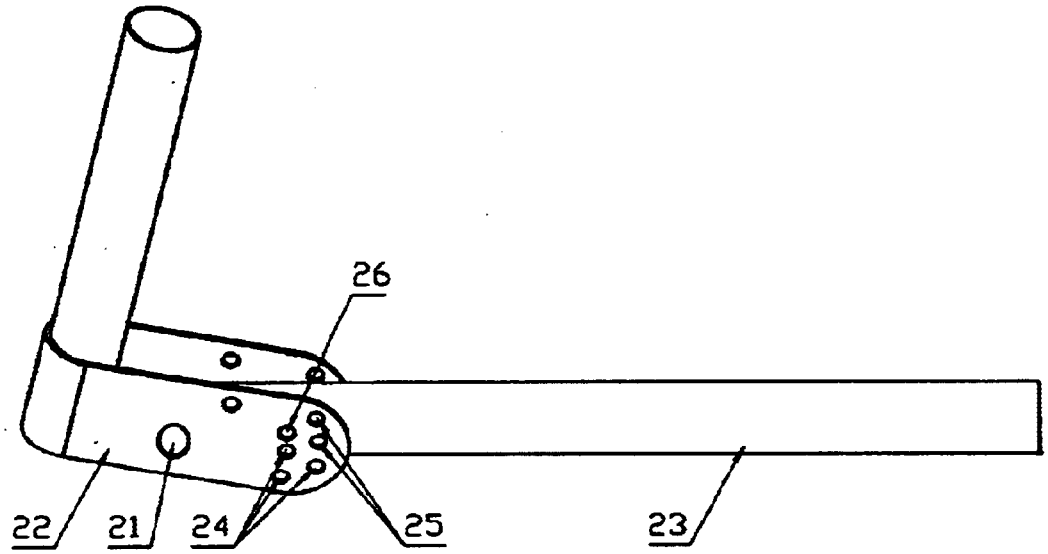

FIGS. 6, 7, and 8 are perspective views of a further alternate embodiment of the backstop or net system of the present invention, shown with the panels thereof pivoted in alternate positions;

FIGS. 9–12 are front elevation views of a further alternate embodiment of the present invention;

FIG. 13 is a side view of an adjustable backstop/net system of this invention; and FIG. 14 is a plan view of a bracket member employed in the adjustable backstop/net system of FIG. 13.

DETAILED DESCRIPTION

By referring to FIGS. 1–14, along with the following detailed disclosure, the preferred construction of several alternate embodiments of the backstop or net system of the present invention can best be understood. However, as will be evident from this disclosure, further alternate embodiments of the present invention can be made without departing from the scope of this invention. Consequently, it is to be understood that the drawings and the following detailed disclosure are provided for exemplary purposes only, and are not intended as a limitation of the present invention.

Figure 1:
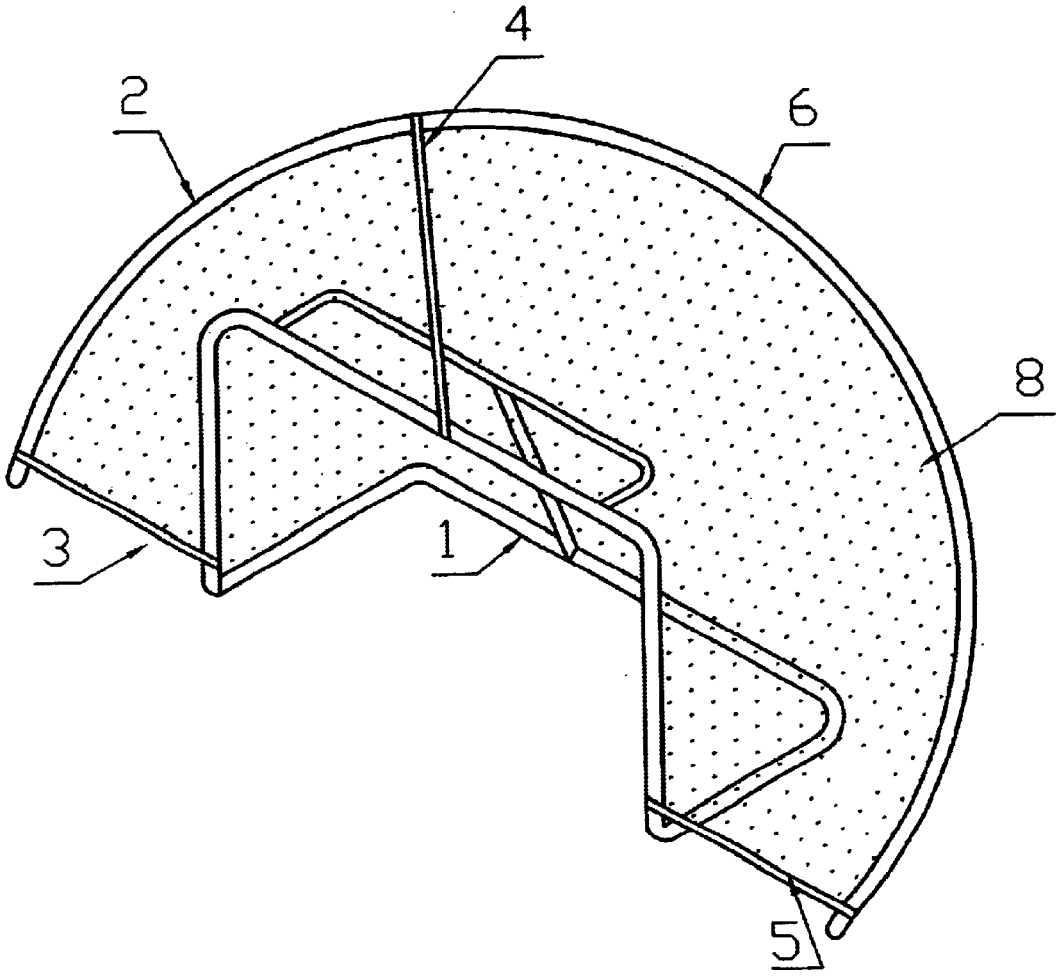
FIG. 1 is a perspective view of a fully assembled backstop or net system of the present invention mounted to a conventional goal assembly.
Figure 2:
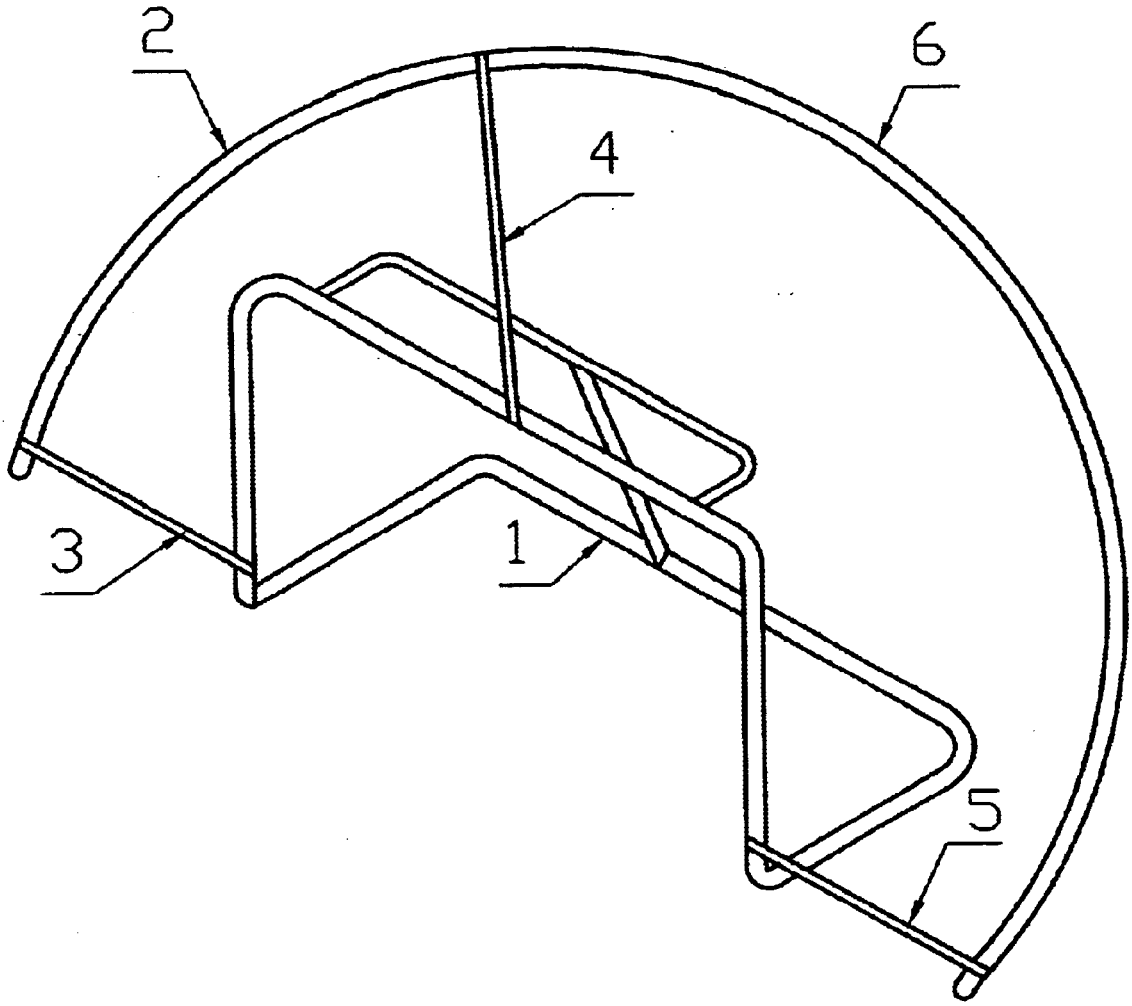
FIG. 2 is a perspective view of the fully assembled backstop or net system of FIG. 1 shown with the netting material removed.

In FIG. 1, fully assembled backstop or net system 2 of the present invention is depicted mounted to a conventional goal assembly 1, while FIG. 2 depicts backstop or net system 2 of the present invention mounted to goal assembly 1 with the net member removed for clarity. As best seen in these Figures, backstop/net system 2 comprises support struts 3, 4, and 5 each of which are independently mounted to an outer edge or rim of goal assembly 1, extending outwardly therefrom. In addition, outer support frame 6 is mounted to the opposed ends of each support strut 3, 4, and 5, providing the terminating edge for backstop/net system 2.

In order to complete the assembly of backstop/net system 2, netting material 8 is secured between the outer edge of goal assembly 1 and the inner edge of support frame 6, extending therebetween and effectively closing the entire area formed between goal assembly 1 and outer support frame 6. In this way, the desired backstop is quickly and easily created, establishing a greatly enlarged area which will catch or stop any shot missing goal assembly 1 which is reasonably close to goal assembly 1. In this way, users will feel secure in having a backstop which will prevent missed shots from hitting property or people in the nearby area.

In the preferred construction of the embodiment depicted in FIG. 1, support frame 6 comprises a plurality of independent members which are constructed for mating interengagement with each other. In this way, outer support frame 6, having any desired size, can be achieved by employing the required number of components to achieve the overall dimensions being sought. In addition, support struts 3, 4, and 5 may be constructed in alternate lengths or, if desired, may also be constructed from a plurality of interfitting components in order to achieve any desired overall dimension.

Figure 3:
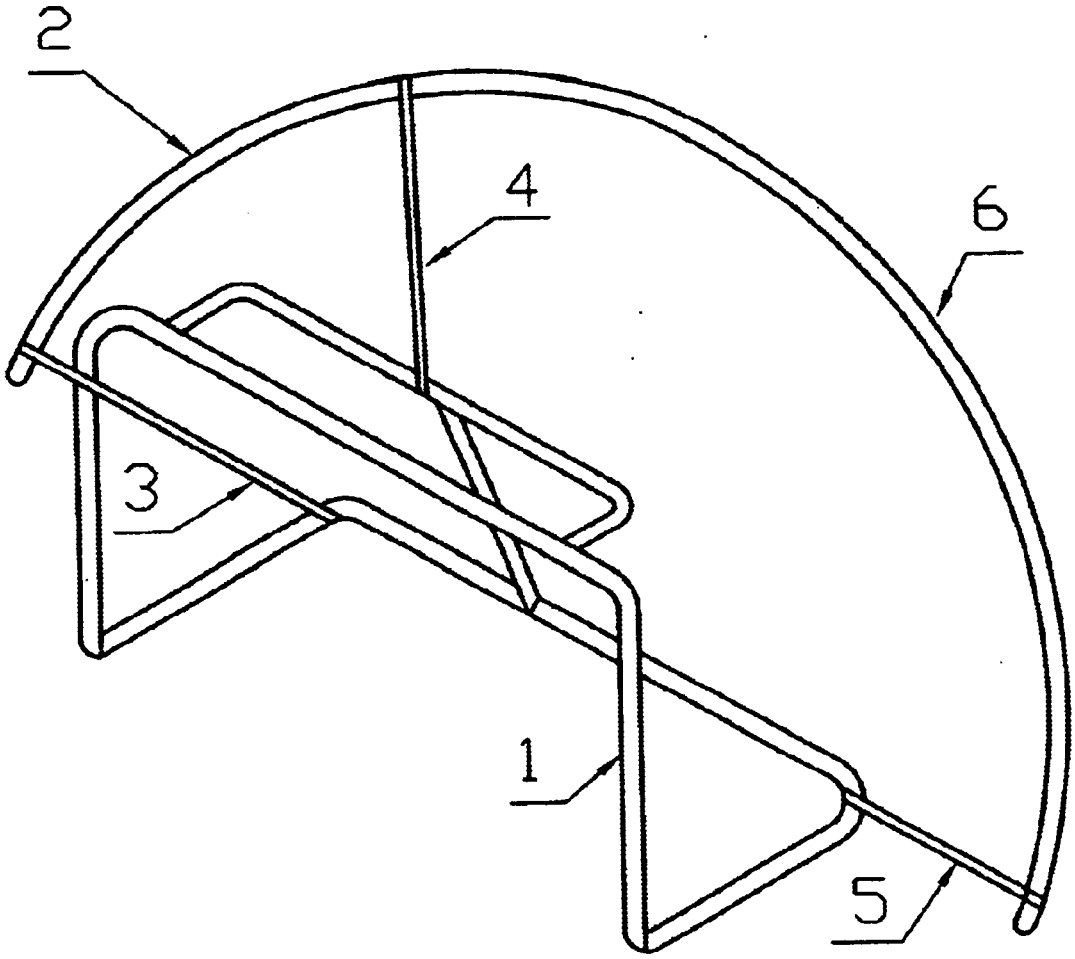
FIGS. 3, 4 and 5 are perspective views of further alternate embodiments of the backstop or net system of the present invention shown mounted to a conventional goal assembly.
Figure 4:
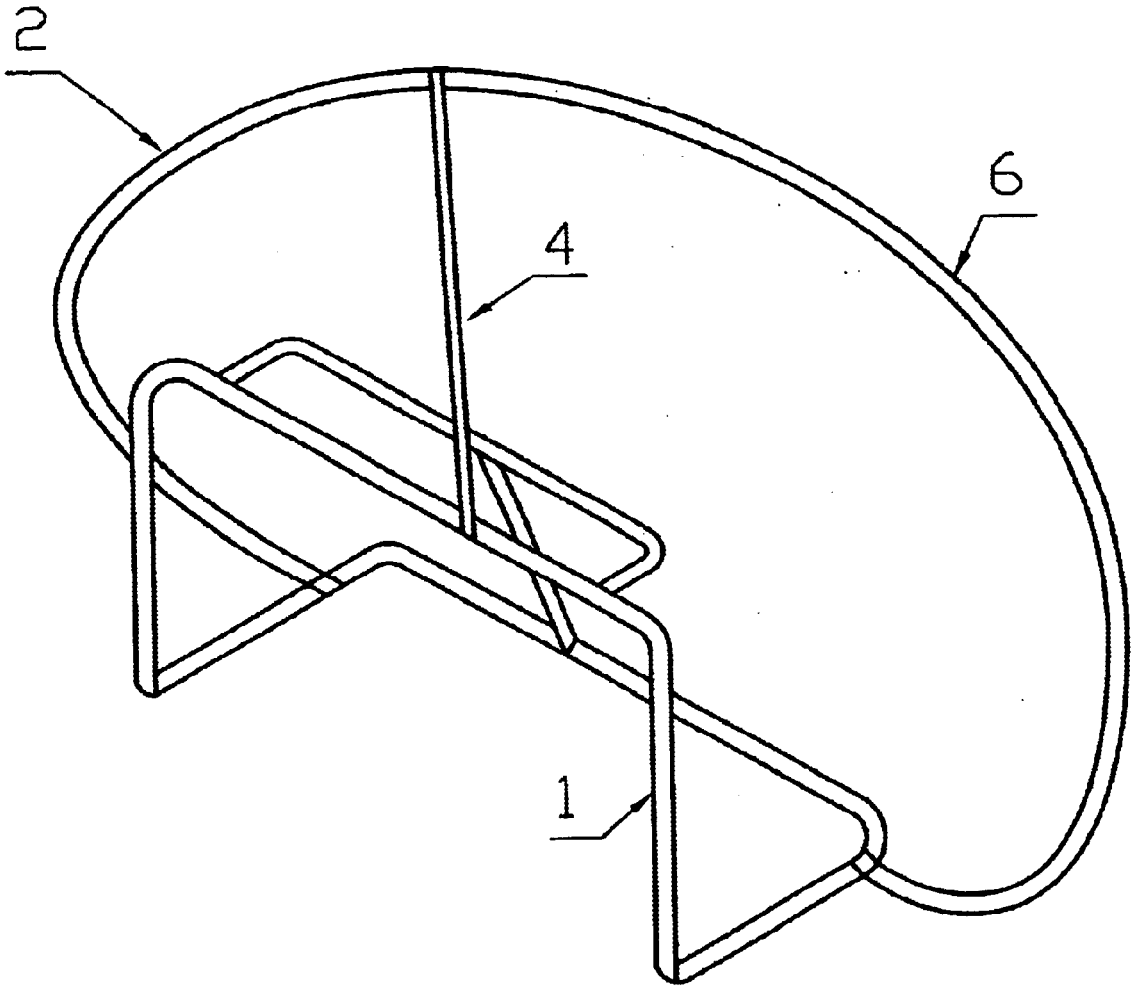
Figure 5:
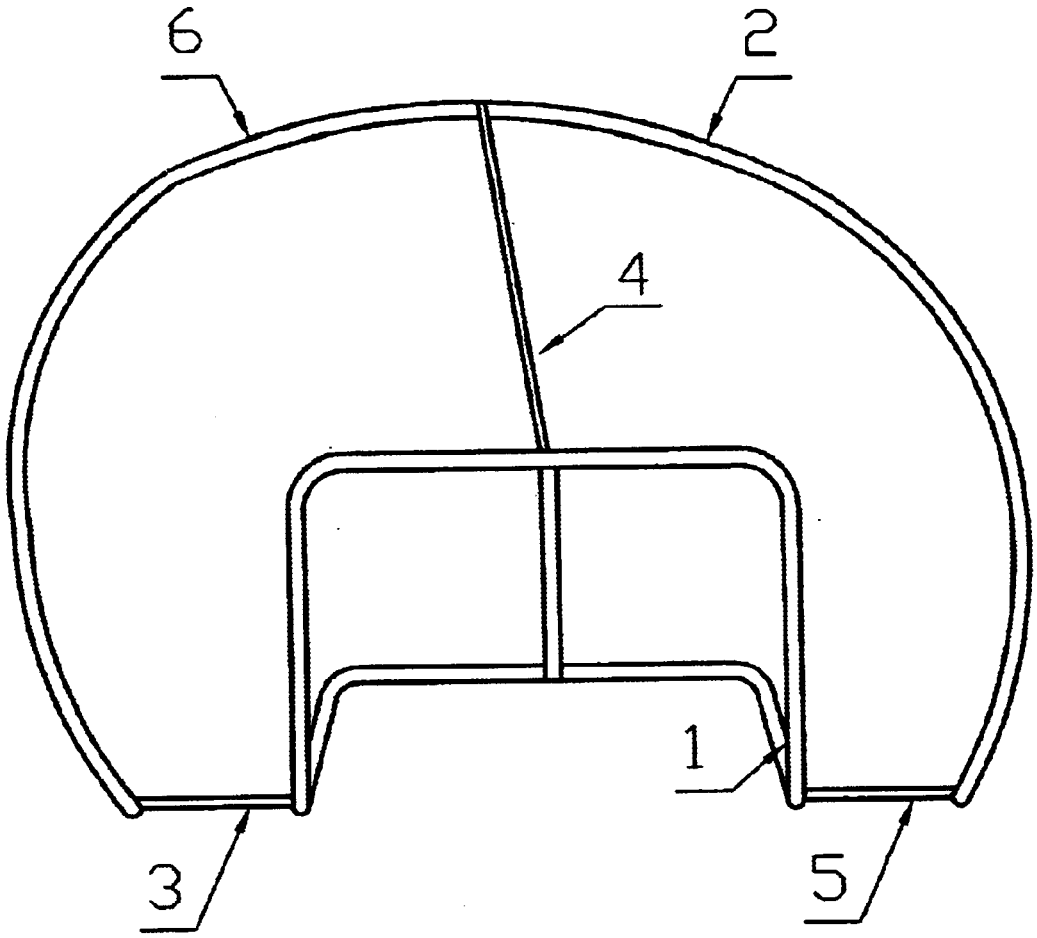

In order to demonstrate various alternate constructions that can be created using the present invention, FIGS. 3, 4, and 5 are provided. In FIG. 3, backstop/net system 2 is depicted mounted to goal assembly 1, with the interconnection thereof being on a rear edge of goal assembly 1. In a further alternate embodiment, as depicted in FIG. 4, backstop/net system 2 is depicted with support frame 6 mounted directly to goal assembly 1 at the terminating ends thereof, with only a single support strut 4 being employed, extending from goal assembly 1 to support frame 6. Finally, FIG. 5 depicts backstop/net system 2 having support frame 6 configured in a further alternate curved shaped, while also employing support strut 4 which is angularly disposed forwardly of goal assembly 1.

In FIGS. 6, 7, and 8, a further alternate embodiment of backstop/net system 2 of the present invention is shown. In this embodiment, generally rectangular shaped frame assemblies 10 and 11 are mounted to opposing side edges of goal assembly 1. In addition, a third generally rectangular shaped frame assembly 12 is mounted along the top edge of goal assembly 1. By employing these components, the desired enlarged, extended area backstop construction is realized and a further easily achieved construction is attained.

As shown in FIGS. 6, 7, and 8, rectangular shaped frame assemblies 10, 11, and 12 each comprise netting material 8 secured to the frame forming tube members of each frame assembly in order to fully enclose the entire area defined by each frame assembly. In this way, the desired backstop protection is realized.

In addition, as clearly shown in FIGS. 6, 7, and 8, frame assemblies 10 and 11 are secured to goal assembly 1 in a manner which enables each frame assembly 10 and 11 to be independently arcuately pivoted relative to goal assembly 1. As a result, the precise configuration and deployment of the each frame assembly 10 and 11 is fully adjustable by the user, in order to achieve any desired configuration or fit any particular situation.

In FIGS. 9–12, a still further, alternate embodiment of the present invention is depicted. In this embodiment, a fully enclosed backstop/net system is achieved which can be used for, any desired sport activities. As a result, the universal applicability and usability of the present invention becomes clearly apparent.

In the embodiments detailed above, goal assembly 1 is depicted in the generally conventional configuration typically employed for sport activities such as hockey, soccer, and football kicking. However, as is evident from the embodiment shown in FIGS. 9–12, as well as the additional embodiments depicted in FIGS. 13–14, alternate constructions of backstop/net system 2 of the present invention may be employed for a wide variety of additional sport activities, including baseball, football passing, tennis, and the like.

As is evident from a review of FIGS. 9–12, in this embodiment, backstop/net system 2 comprises goal assembly 1, and frame assemblies 10, 11, and 12, each of which are constructed in the manner detailed above. However, in this embodiment, goal assembly 1 incorporates connecting rod 15, mounted at the intersection of vertical U-shaped frame member 13 and horizontal U-shaped frame member 14 which form goal assembly 1. In the preferred construction, connecting rod 15 extends completely between the two junctures of U-shaped frame members 13 and 14, forming an elongated continuous support rod therefor.

In addition, in this embodiment, netting panel 16 is mounted to U-shaped frame member 13 and connecting rod 15 effectively covering and blocking the open zone otherwise established by U-shaped frame member 13. In this way, as clearly depicted in FIG. 9, this embodiment of backstop/net system 2 provides a greatly enlarged fully protected area for use by any sports enthusiasts and virtually any sport activity. In addition, as clearly shown in FIG. 10, netting panel 16 is constructed for rapid, easy affixation to U-shaped frame member 13 and connecting rod 15 by employing a loop and eyelet fastening system 17.

Figure 11:
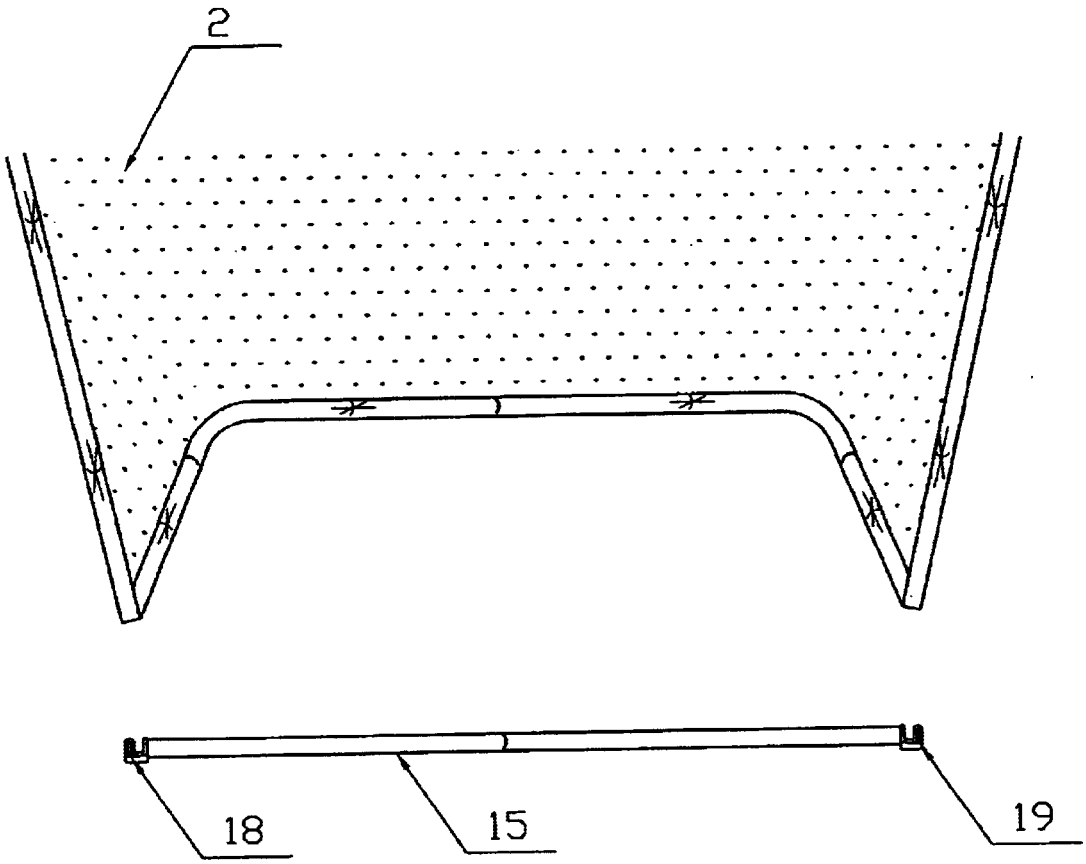

In the preferred construction, connecting rod 15 is quickly and easily mounted to U-shaped frame member 13 or U-shaped frame member 14 of goal assembly 1 by employing bolt means 18 and 19, shown in FIG. 11. If desired, bolt means 18 and 19 may be threadedly mounted in place in U-shaped frame members 13 or 14 or, alternatively, bolt means 18 and 19 may comprise smooth surfaces which are merely inserted into U-shaped frame members 13 or 14 in order to secure connecting rod 15 in the desired location.

Figure 12:
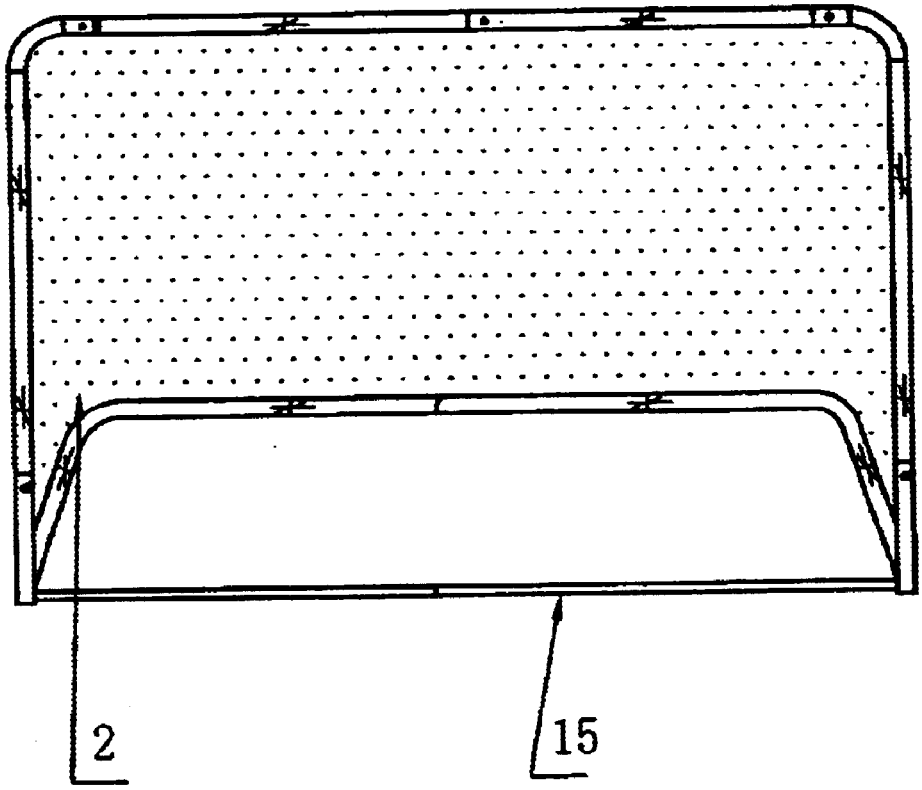

Once connecting rod 15 is secured to U-shaped frame member 13 or 14, as depicted in FIG. 12, the assembly is ready for mounting netting member 16 in place in order to cover the previously open zone. In this way, a wide, expansive, easily assembled backstop/net system 2 is realized for use in any desired sport activity.

In addition to the need and desirability of the various constructions for backstops/net systems as detailed above, sports enthusiasts also desire to have a backstop/net system which is adjustable for enabling baseballs, football, soccer balls, etc. to be automatically returned to the user after hitting the backstop/net system. Although various prior art constructions do exist, prior art constructions are incapable of satisfying all of the needs and requirements desired by users. In order to fill this long felt need, further alternate embodiment of the present invention had been developed and are fully depicted in FIGS. 13–20.

One embodiment of backstop/net system 2 of the present invention is shown in FIGS. 13 and 14. In this embodiment, backstop/net system 2 comprises goal assembly 1 which incorporates U-shaped frame member 13 and U-shaped frame member 14 interconnected to each other for cooperative association. Although this general construction has been discussed in detail above, in this embodiment of the present invention, pivot bracket 21 interconnects U-shaped frame member 13 with U-shaped frame member 14 in order to enable U-shaped frame member 13 to be arcuately pivotable relative to U-shaped frame member 14 in a plurality of alternate lockable positions.

In this regard, in order to attain a backstop/net system which provides this arcuate, pivotable capability, bracket member 21 comprises L-shaped arm member 22 and rod member 23 mounted thereto. L-shaped arm member 22 and rod member 23 are constructed with the distal ends thereof constructed for insertion and engagement in U-shaped frame members 13 and 14. In addition, L-shaped bracket member 22 incorporates a plurality of apertures 24 form therein, with rod member 23 incorporating passageways 25 and 26 formed therein, positioned for aligned cooperating relationship with apertures 24 of L-shaped bracket 22.

By employing this construction, rod member 23 is capable of being arcuately pivoted relative to L-shaped arm member 22 and then securely retained in any one of the plurality of alternate angular positions relative thereto, by inserting a locking pin through apertures 24 and passageway 25 or 26. By employing this construction and angular locking operation, U-shaped frame member 13 is quickly and easily arcuately pivoted relative to U-shaped frame member 14 for being securely locked in any desired angular relationship thereto.

In addition to this construction, backstop/net system 2 of this embodiment also incorporates connecting rod 15 with netting panel 16 mounted thereto as detailed above. In this way, the otherwise open zone of U-shaped frame member 13 is completely covered and blocked by a secure, tight and responsive net member. By employing this construction, a user is capable of placing netting panel 16 in a plurality of alternate arcuate positions, thereby enabling the user to employ backstop/net system 2 of this embodiment as a blocking surface, while also providing a pitch back or return function for propelling the baseball, football, soccer ball, hockey puck, etc. back to the user for repeated shots.

It will thus be seen that the objects set forth above, among those made apparent from the preceding description, are efficiently attained and, since certain changes may be made in the above the article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A universally employable, easily constructed, fully adjustable multi-purpose backstop or net system constructed for cooperating with a conventional hockey goal assembly incorporating support members and netting interconnected thereto, said backstop/net system comprising:

A. a first rectangular shaped panel assembly comprising an overall length substantially greater than the height of the hockey goal assembly and
   a. mounted to a first side edge of the hockey goal assembly,
   b. extending above the hockey goal assembly, and
   c. arcuately pivotable relative to the first side edge through an arc of at least 180° to extend from said first side edge in a desired direction;

B. a second rectangular shaped panel assembly comprising an overall length substantially greater than the height of the hockey goal assembly and
   a. mounted to a second side edge of the hockey goal assembly,
   b. extending above the hockey goal assembly, and
   c. arcuately pivotable relative to the second side edge through an arc of at least 180° for being selectively positionable to extend from said second side edge in a desired direction; and C. third rectangular shape panel assembly comprising an overall length substantially equivalent to the width of the hockey goal assembly and mounted to a top edge of the hockey goal assembly, extending between and interconnected with the first rectangular shaped panel assembly and the second rectangular shaped panel assembly, whereby a backstop/net system is created which peripherally surrounds the entire hockey goal assembly in a manner which achieves the desired errant shot blocking effect while also providing complete adjustability of the position of the side panels.

2. The multi-purpose backstop/net system defined in claim 1, wherein each of said rectangular shaped frame assemblies comprises a rectangular shaped frame member defining the outer peripheral edge thereof and netting material affixed to the frame member for effectively closing the entire zone defined thereby, whereby the desired area is completely protected by netting material for capturing errant shots.

3. The multipurpose backstop/net system defined in claim 2, wherein both the first rectangular shaped panel assembly and the second rectangular shaped panel assembly are arcuately pivotable relative to the hockey goal assembly.

4. A universally employable, easily constructed, fully adjustable, multi-purpose backstop or net system comprising:

A. a hockey goal assembly incorporating a. a first U-shaped support member mounted to a second U-support member at the terminating ends thereof, defining a substantially 90 degree angle therebetween, b. said first U-shaped support members being maintained in a substantially vertical plane, with said second U-shaped support member being in a substantially horizontal plane, and C. netting material extending from said first U-shaped support member to set a second U-shaped support member for effectively establishing a rearwardly extending holding zone therein; and B. a first rectangular shaped panel assembly comprising an overall length substantially greater than the height of the first U-shaped support member and a. mounted to a first side edge of the first U-shaped support member, b. extending above said first U-shaped support member, and C. arcuately pivotable relative to the first side edge through an arc of at least 180° to extend from said first side edge in a desired direction; and C. a second rectangular shaped panel assembly comprising an overall length substantially greater than the height of the first U-shaped support member and a. mounted to a second side edge of the first U-shaped support member, b. extending above said first U-shaped support member, and C. arcuately pivotable relative to the second side edge through an arc of at least 180° for being selectively positionable to extend from said second side edge in a desired direction; and D. a third rectangular shaped panel assembly comprising an overall length substantially equivalent to the width of the first U-shaped support member and mounted to the top edge of the first U-shaped support member, extending between and interconnected with the first rectangular shaped panel assembly and the second rectangular shaped panel assembly.

5. The multipurpose backstop/net system defined in claim 4, wherein each of said rectangular shaped frame assemblies comprises a rectangular shaped frame member defining the outer peripheral edge thereof and netting material affixed to the frame member for effectively closing the entire zone defined thereby, whereby the desired area is completely protected by netting material for capturing errant shots.

6. The multipurpose backstop/net system defined in claim 5, wherein both the first rectangular shape panel assembly and the second rectangular shape panel are arcuately pivotable relative to the first U-shaped support member.

7. The multi-purpose backstop/net system defined in claim 4, and further comprising:

E. a substantially flat netting panel affixed at its terminating edges to the first U-shaped support member for effectively closing and blocking the open zone formed by said first U-shaped support member, establishing and easily constructed pitch-back system for use with a plurality of sport activities.

8. The multi-purpose backstop/net system defined in claim 7, wherein said system further comprises an elongated rod member incorporating fastening means for quickly and easily affixing the rod member to the first U-shaped support member at the base thereof, effectively closing the fourth edge of said first U-shaped support member and providing an additional surface to which the netting panel is affixed.

9. The multi-purpose backstop/net system defined in claim 8, wherein the substantially flat netting panel is further defined as comprising circular disks affixed to a plurality of terminating loop members formed at the outer edge of said panel for enabling said loop members to be wrapped about the U-shaped support member and the rod member quickly and easily, and being fastened in place by passage through a cooperating portion of the loop member.

10. The multipurpose backstop/net system defined in claim 8, wherein said system further comprises a pair of arcuately pivotable bracket members mounted between and interconnecting the first U-shaped support member with the second U-shaped support member for enabling said first U-shaped support member to be movable in a plurality of alternate positions, with each of said positions defining a unique angular relationship therebetween, whereby said backstop/net system is able to achieve a pitch-back construction wherein the netting panel is capable of being positioned in a plurality of alternate desirable orientations.

* * * * *